US006223708B1

(12) United States Patent
Kampichler et al.

(10) Patent No.: US 6,223,708 B1
(45) Date of Patent: May 1, 2001

(54) AUTOMATIC DECOMPRESSION SYSTEM

(75) Inventors: Guenter Kampichler, Ruhstorf; Udo Griebl, Passau, both of (DE)

(73) Assignee: Motorenfabrik Hatz GmbH & Co. KG, Ruhstorf (DE)

( * ) Notice: Subject to any disclaimer, the term of this patent is extended or adjusted under 35 U.S.C. 154(b) by 0 days.

(21) Appl. No.: 09/254,579

(22) PCT Filed: Sep. 4, 1997

(86) PCT No.: PCT/EP97/04799

§ 371 Date: May 13, 1999

§ 102(e) Date: May 13, 1999

(87) PCT Pub. No.: WO98/11330

PCT Pub. Date: Mar. 19, 1998

(30) Foreign Application Priority Data

Sep. 11, 1996 (DE) ..... 196 36 811

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | |
|---|---|---|---|
| 4,590,905 | 5/1986 | Matsuki et al. . | |
| 4,615,313 | 10/1986 | Tsumiyama . | |
| 5,301,643 | 4/1994 | Garcyalny . | |
| 5,706,769 * | 1/1998 | Shimizu | 123/90.23 |

FOREIGN PATENT DOCUMENTS

| | | | |
|---|---|---|---|
| 0 167 691 * | 1/1986 | (EP) | 123/182.1 |
| 0 515 182 A1 | 11/1992 | (EP) . | |
| 2 522 725 | 9/1983 | (FR) . | |
| 63-306215 | 12/1988 | (JP) . | |
| 9-184410 * | 7/1997 | (JP) . | |

* cited by examiner

*Primary Examiner*—Andrew M. Dolinar
(74) *Attorney, Agent, or Firm*—Helfgott & Karas, P.C.

(57) ABSTRACT

An automatic decompression system for an internal combustion engine, especially a one-cylinder diesel engine, with at least one outlet and one inlet valve, which are activated by a camshaft (20) with at least one cam (1), wherein the outlet valve is lifted during starting to reduce the cranking resistance, wherein there is provided for lifting the outlet valve at speeds below a switching speed for changeover from decompression to compression a fully automatic lifting device, which engages in the cam (1) of the outlet valve and effects lifting of the outlet valve from the valve seat, wherein the lifting device is equipped with a bow-shaped member (22), pivoted in articulated relationship, disposed between cam (1) and a cam disk (2), which bow-shaped member has two articulated arms (11) and a crosspiece (14) joining them, and which at speeds below the switching speed occupies in the cam plane an engaged decompression position, in which it projects beyond the cam base circle, and which can be disengaged into a neutral position in the cam-disk plane when the switching speed is reached, is provided for the purpose of speed-dependent control of the engagement and disengagement process with at least one flyweight (3), which is subjected by a spring (5) to radially inward pressure and which is coupled flexibly with the bow-shaped member.

11 Claims, 4 Drawing Sheets

AUTOMATIC DECOMPRESSION SYSTEM

The subject matter of the present invention is an automatic decompression system for an internal combustion engine, especially a one-cylinder diesel engine, with at least one outlet and one inlet valve, which are activated by a camshaft with at least one cam, wherein the outlet valve is lifted during starting to reduce the cranking resistance and with further features according to the preamble of claim 1.

From the prior art there are known devices which reduce the cranking resistance during starting of internal combustion engines. Most are semi-automatic devices which lift the outlet valve by a few tenths of one millimeter by a manually operated lever and, after one working cycle during reversing start or after several working cycles during hand-cranked start, switch from decompression to compression by means of a restoring or latching mechanism. Also known from the prior art are decompression devices which, under centrifugal control, lift only one of the valves (inlet or outlet valve) by a few tenths of one millimeter for a specified, short angular range around ignition TDC and, when a specified crankshaft speed is reached, switch again from decompressed to compressed condition. Yet another starting aid operating under centrifugal control is known from European Patent EP 0515183 A1. Because of the rigid connection between flyweight and bow-shaped member, a relatively large installation space is needed this device. The object of the present invention is therefore to provide an easy-to-make, low-cost automatic decompression system which operates completely automatically by purely mechanical regulation and needs only a small installation space. This object is achieved by the automatic decompression system of the present invention. Therein there is provided for lifting the outlet valve at speeds below a switching speed for changeover from decompression to compression a fully automatic lifting device, which effects lifting of the outlet valve from the valve seat. In this way the lifting device effects lifting of the valve as long as the camshaft is rotating more slowly than a specified switching speed. This leads advantageously to reduction of the cranking resistance during starting, whereby the internal combustion engine is started either manually by reversing cable or by crank or electrically by means of a small starter motor. Above the switching speed the lifting device is inactive, and so the valve is not lifted and thus full compression takes place. Furthermore, the invention provides that the lifting device is equipped with a bow-shaped member, pivoted in articulated relationship, disposed between the cam and a cam disk, which bow-shaped member has two articulated arms and a crosspiece joining them, and which at speeds below the switching speed occupies in the cam plane an engaged decompression position, in which it projects beyond the cam base circle, and which can be disengaged into a neutral position in the cam-disk plane when the switching speed is reached. This bow-shaped member is designed such that it can swivel around a rotary pivot disposed in a plane parallel to the cam plane and, in fact, in such a way that the bow-shaped member is engaged in the cam plane with the crosspiece disposed transverse to the articulated arms and projects beyond the cam base circle when the camshaft is turning slowly or is stopped. By this space-saving arrangement, the valve is slightly lifted from its closed position, or in other words raised from the valve seat, as long as it is controlled by the cam in the region of the crosspiece. After the specified switching speed has been reached, a restoring force is exerted on the articulated arms, causing swiveling movement of the bow-shaped member, whereby the crosspiece is disengaged into the cam-disk plane. Hereby there is created in simple manner with purely mechanical means a completely automatic decompression system, which has only a small space requirement in the assembly chamber. Furthermore, the invention provides that, for speed-dependent control of the engagement and disengagement process of the bow-shaped member for decompression or compression respectively, there is provided at least one flyweight held in a specified rest position by a pretensioning spring and subjected in radial direction to inward pressure. The mass of this flyweight is dimensioned such that it occupies its outermost radial position against the pressure of the spring at the defined switching speed, or in other words such that it bears against a stop in this position. In addition, the pretensioning spring ensures that the flyweight when in rest position is held in a specified position regardless of gravitational forces. In dimensioning the mass of the flyweight as a function of switching speed, the pretensioning force of the spring must be taken into consideration. By the coupling of the flyweight mechanism with the bow-shaped member pivoted in articulated relationship, engagement and disengagement of the bow-shaped member as a function of switching speed is achieved in simple manner.

In this connection an advantageous embodiment of the invention provides that the inside radius of one of the flyweights is shaped as a ramp to engage the bow-shaped member against the resistance of a disengaging spring. In this structural embodiment, the turning knuckle of the bow-shaped member is disposed approximately at the height of the longitudinal axis of the camshaft parallel to the cam plane. For this purpose the articulated arms are provided with a lever arm extending to the crosspiece and a lever arm extending from the joint in the direction opposite the crosspiece. The lever arm is loaded by the disengaging spring, whereby the bow-shaped member is held in its disengaged position as long as the flyweight occupies its outermost radial position at speeds above the switching speed. At speeds of rotation below the switching speed, the ramp-like face of the inside radius of the flyweight bears against the crosspiece, causing the bow-shaped member to be held in its engaged position against the pretension exerted by the disengaging spring.

A further advantageous embodiment of the present invention provides that the flyweight is coupled with the bow-shaped member via a driver disposed on the articulated arm. In this embodiment, the driver, designed as a lever, is coupled directly with a driving arm of the flyweight. When the switching speed is reached, the flyweight drives the driver to the extent that the bow-shaped member tilts outward to its disengaged position and becomes positioned in the cam-disk plane. Below the switching speed, the driving arm holds the bow-shaped member in its engaged position, in which the crosspiece is disposed in the cam plane.

Finally, it is advantageous for two bow-shaped flyweights to be provided, which are coupled with each other by a joint. Hereby the influence of gravitational forces is advantageously eliminated by the restraining effect of two opposite flyweights. Thereby it is possible to achieve very low switching speeds, which is advantageous in particular for reversing starts.

Another advantageous embodiment of the invention provides that lifting in decompression position takes place in a specified crank-angle range of approximately 90° by appropriate arc length of the bow-shaped member. This is the range available after closing of the inlet valve and before attainment of ignition TDC or after ignition TDC and before opening of the outlet valve. For reasons of valve-play adjustment capability, a range without valve lift must be provided at ignition TDC.

Furthermore, it is advantageous for the switching speed to be between 300 and 600 rpm, preferably 400 rpm. By selecting such a switching speed, manual starting is still possible even at extremely low temperatures, or the engine can be turned with a low-power starter.

Finally, an advantageous embodiment provides that the control cam is provided with a slot to accommodate the bow-shaped member in engaged position. Hereby the bow-shaped member retains its specified position and is protected from deformation.

Yet another advantageous further embodiment of the present invention provides that the inlet valve can be actuated via the same cam as the outlet valve and, in the direction of rotation of the camshaft after the outlet valve, is lifted in addition thereto during the decompression phase. Therein lies the advantage that, in combination with reversing or kick-start devices, the cranking resistance is reduced by the proportion of charge-changing work to be expended for the suction stroke. Thereby it is also ensured that no unfiltered intake can take place from the exhaust line.

Finally, it is advantageous for the closing of the outlet valve to take place 40° before ignition TDC and the opening of the inlet valve 40° after ignition TDC. Thereby both valves are reliably closed at ignition TDC.

Finally, a further embodiment of the present invention provides that a valve-dragging lever is provided between cam and valve. This can activate the valve directly or via a tappet rod.

Finally, it is advantageous for the valve-dragging lever to be liftable by 0.2 mm to 0.6 mm, preferably 0.4 mm, by the lifting device. Depending on movement ratio, this causes lifting of the valves by between 0.3 and 0.8 mm.

Advantageous embodiments of the present invention will be explained in more detail hereinafter with reference to the attached figures, wherein.

Figure 6A:
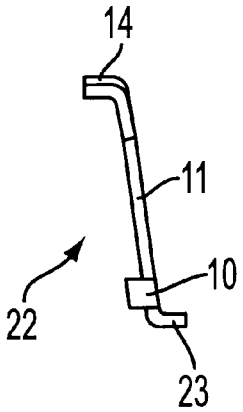
Figure 6B:
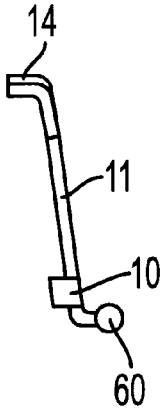
Figure 6C:
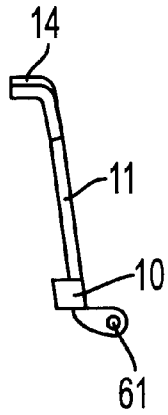
Figure 7:
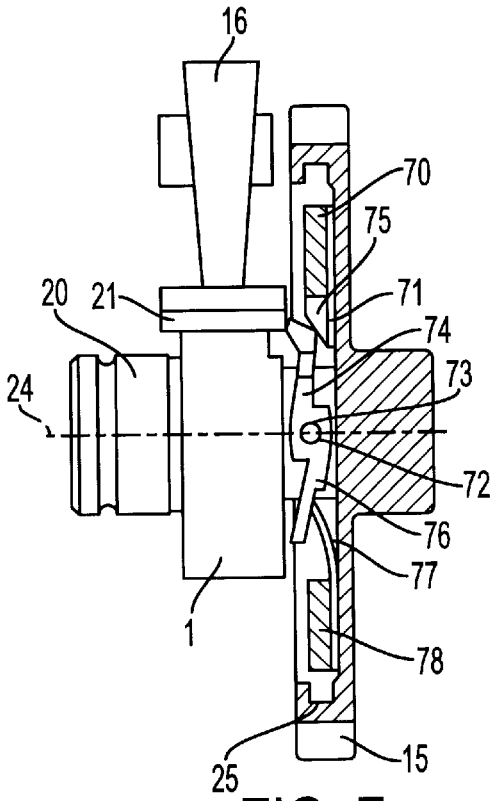
Figure 8:
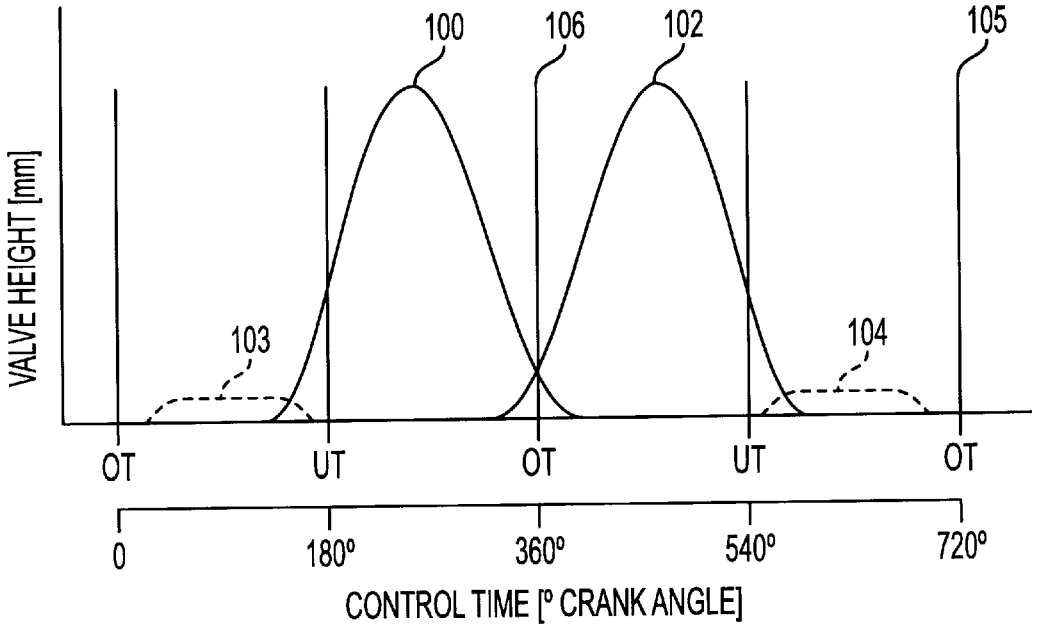

FIGS. 6*a*–6*c* show different embodiments of a bow-shaped member according to the invention;

FIG. 7 shows a further embodiment of the automatic decompression system according to the invention in cutaway side view;

FIG. 8 shows a valve-control characteristic diagram with decompression.

Figure 1:
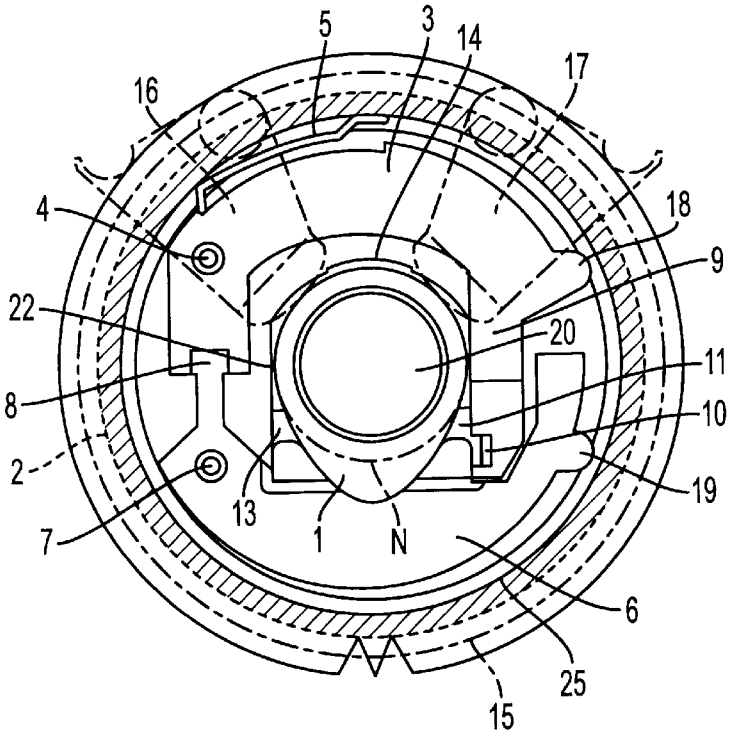
FIG. 1 shows a front view of a first embodiment of the automatic decompression system according to the invention.

FIG. 1 shows a front view of a first embodiment of the automatic decompression system according to the invention with cam 1 disposed on camshaft 20 and a cam disk 2. In the cam-disk plane there are pivoted a first flyweight 3, which is pivoted at a point 4 and is pressed radially inward by a spring 5, a second flyweight 6 with a further bearing point 7 and the common joint 8 as well as driving arm 9 and bow-shaped member 22. Driver 10, articulated arm 11 joined thereto, second articulated arm 13 and crosspiece 14 form bow-shaped member 22. Toothing 15 of cam disk 2 as well as cam base circle are indicated by a dot-dash line. Also represented by dot-dash lines are dragging lever 16 for the outlet valve and dragging lever 17 for the inlet valve. Also illustrated are nose 18 of first flyweight 3 as well as nose 19 of second flyweight 6, each of which is disposed at the ends of the bow-shaped flyweights opposite bearing points 4 and 7.

Hereinafter like parts will be denoted by like reference symbols.

Figure 2:
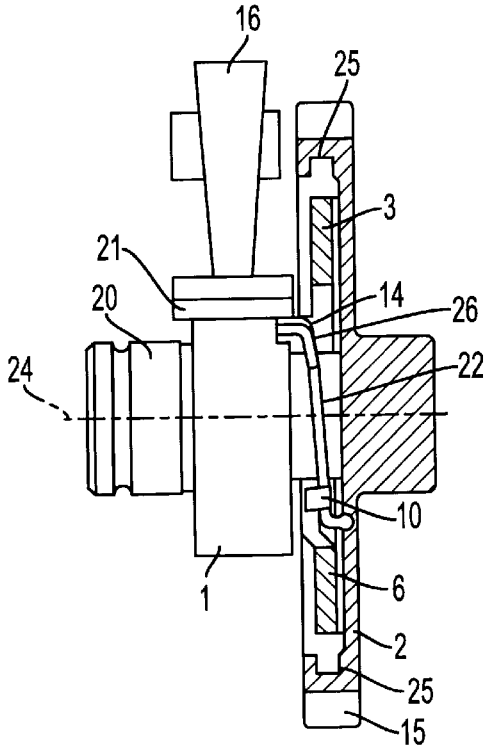
FIG. 2 shows a cutaway side view of the automatic decompression system according to FIG. 1.

FIG. 2 shows a cutaway side view of the automatic decompression system according to FIG. 1. Therein only dragging lever 16 of the outlet valve is illustrated. This is provided with a sliding face 21, which bears on cam 1 and, depending on the lifting movement thereof, opens or closes the outlet valve. On both articulated arms, bow-shaped member 22 with crosspiece 14 and articulated arm 11 as well as driver 10 is pivoted in swiveling relationship on a bearing 23 in cam disk 2. Also illustrated are camshaft 20, first flyweight 3 and second flyweight 6 as well as toothing 15 of cam disk 2.

Figure 4:
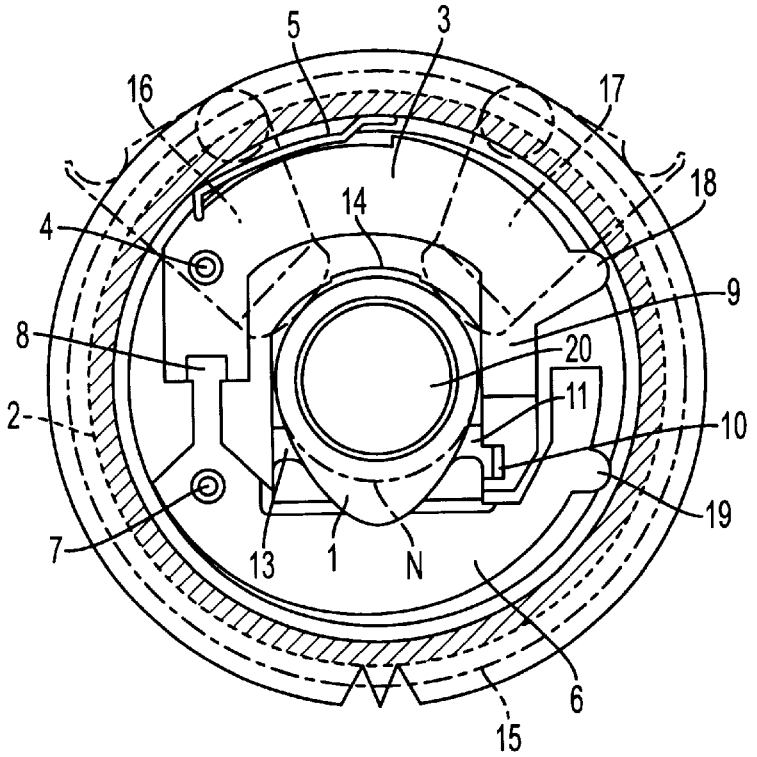
FIG. 4 shows an automatic decompression system according to FIG. 1 after the switching speed has been reached.
Figure 5:
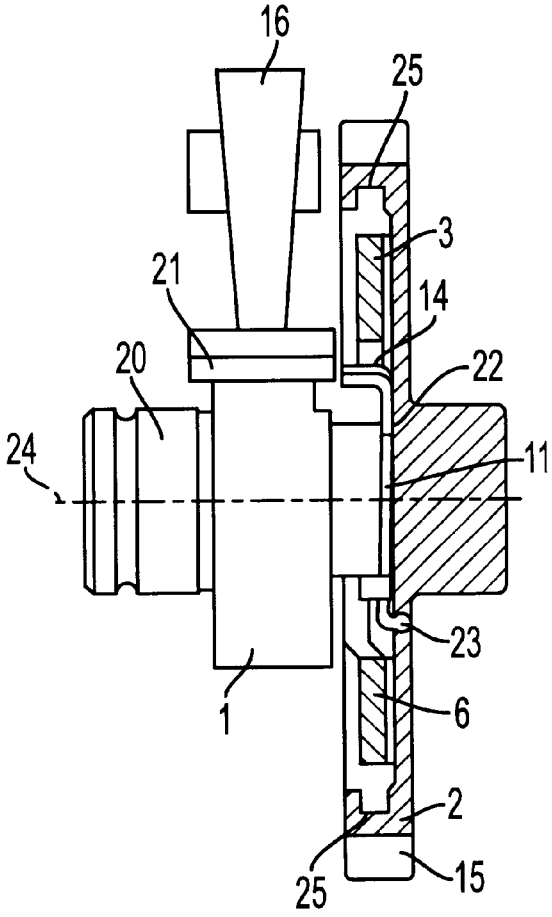
FIG. 5 shows a cutaway side view of the automatic decompression system according to FIG. 1 after the switching speed has been reached.

FIGS. 1 and 2 describe a condition of the automatic decompression system when it is stopped or rotating at speeds below the switching speed. In this condition, first flyweight 3 is pressed radially inward by spring 5 and second flyweight 6 is also held in radially inward direction via articulated joint 8. Hereby driving arm 9 holds driver 11 in a position distant from camshaft axis 24, whereby crosspiece 14 of bow-shaped member 22 is disposed in engaged position in the camshaft plane. When a switching speed is reached, the centrifugal force of the two flyweights 3 and 6 is greater than the radially inward force of spring 5, whereby the flyweights are forced radially outward until noses 18 and 19 are stopped against slot bottom 25 of the cam disk. In this condition, driver 10 is moved into a position close to axis 24 of the camshaft, whereby bow-shaped member 22 is disengaged into a neutral position in the cam-disk plane. This condition is illustrated in FIGS. 4 and 5.

Figure 3:
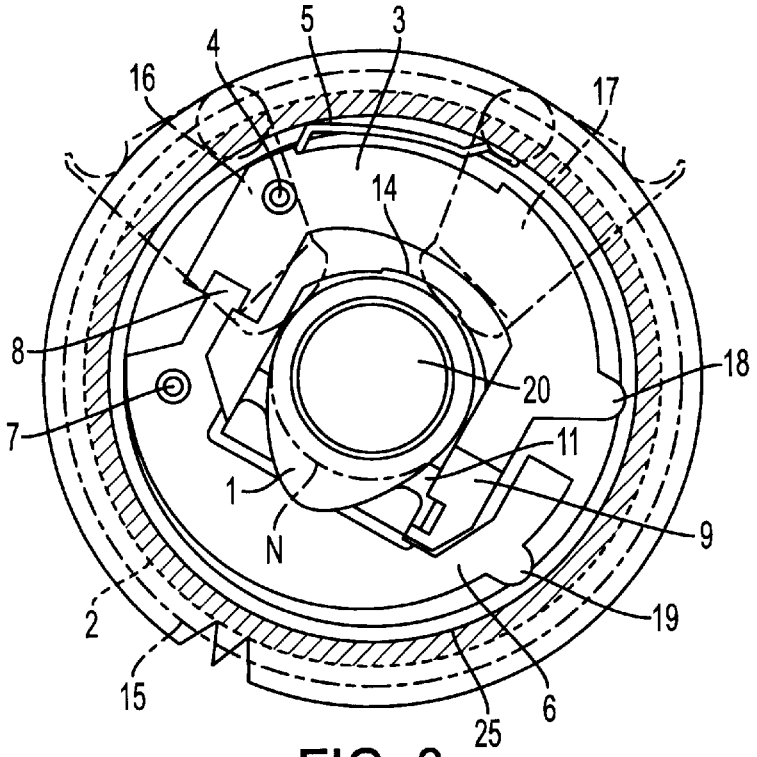
FIG. 3 shows a front view of the automatic decompression system according to FIG. 1, wherein the inlet valve is lifted.

In the engaged condition, crosspiece 14 engages in a slot 26 of cam 1, whereby crosspiece 14 of bow-shaped member 22 projects by a few tenths of one millimeter beyond cam base circle N. If the cam disk from FIG. 1 now turns further clockwise, the engaged bow-shaped member first lifts dragging lever 17 of the inlet valve by a few tenths of one millimeter, the effective crank-angle range being determined by the arc length of bow-shaped member 22, or in other words by the length of crosspiece 14. This condition is illustrated in FIG. 3. When further turned, cam 1 first opens the outlet valve and then the inlet valve and, after the outlet valve has closed, lifts it slightly again by the engaged bow-shaped member. This engagement and disengagement of the bow-shaped member takes place, as already described, under centrifugal control, wherein engagement during reengagement can take place only if the bow-shaped member is not disposed exactly at the height of a dragging lever.

FIGS. 6*a* to 6*c* show side views of various embodiments of a bow-shaped member according to the invention. Therein not only articulated arm 11 and crosspiece 14 but also driver 10 and a knife edge 23 functioning as a joint are illustrated. FIG. 6*b* shows a bow-shaped member in which the bearing is formed by a ball 60. FIG. 6*c* finally shows the side view of an embodiment of a bow-shaped member according to the invention, wherein the bearing is formed by a pivot 61.

FIG. 7 shows a further embodiment of an automatic decompression system according to the invention. This is distinguished from the embodiment described hereinabove on the one hand by the fact that first flyweight 70 is provided with an inside radius designed as a ramp 71, and on the other hand by the fact that bow-shaped member 72 can be swiveled around a pivot 73 passing through the centerline of the camshaft. Bow-shaped member 72 is provided not only with articulated arm 74 and crosspiece 75 but also lever arm 76, which is loaded by a spring 77. Hereby, at speeds higher than the switching speed, the bow-shaped member is disengaged and held in this position. Below the switching speed, the bow-shaped member is pushed by ramp 71 against the spring force of spring 77 into its engaged position in the cam plane and held in this position until the flyweight drifts outward once again.

FIG. 8 shows a valve-control characteristic diagram of decompression, in which 100 denotes the valve-height curve of the outlet valve, 102 the valve-height curve of the inlet valve, 103 the valve height due to the automatic decompression system at the inlet valve, and 104 the valve height due to the automatic decompression system at the outlet valve. Ignition TDC is denoted by 105 and the overlap TDC by 106. It is clearly evident from this characteristic diagram that no lifting of the valve takes place approximately 40° before ignition TDC and 40° after ignition TDC.

What is claimed is:

1. An automatic decompression system for an internal combustion engine with at least one outlet valve and one inlet valve which are activated by a camshaft having at least one cam, and wherein said at least one outlet valve is lifted from its valve seat during starting to reduce cranking resistance, said system comprising:

a fully automatic lifting device for lifting the at least one outlet valve at speeds below a switching speed for change over from compression to decompression, which fully automatic lifting device engages in the cam of the at least one outlet valve and effects lifting of the at least one outlet valve from its valve seat, wherein the fully automatic lifting device is equipped with a bow-shaped member pivoted in articulated relationship and disposed between the at least one cam and a cam disk, which bow-shaped member has two articulated arms pivoted at points in a radial plane of the cam disk and connected by a crosspiece, and wherein at engine speeds below the switching speed said bow-shaped member occupies in the cam plane an engaged decompression position, in which said bow-shaped member projects beyond the cam base circle, and when the switching speed is reached said bow-shaped member can be disengaged into a neutral position in the cam-disk, and wherein at least one flyweight is coupled to the bow-shaped member and biased by a spring in a radial direction to control the engagement and disengagement of the bow-shaped member depending on the engine speed.

2. An automatic decompression system according to claim 1, wherein an internal radius of the flyweight is designed as a ramp for engaging the bow-shaped member against the resistance of a disengaging spring thereby coupling the flyweight to the bow-shaped member.

3. An automatic decompression system according to claim 1, wherein the flyweight is coupled with the bow-shaped member via a driver disposed on an articulated arm.

4. An automatic decompression system according to claim 1, wherein two bow-shaped flyweights are provided, which are connected to each other by a joint.

5. An automatic decompression system according to claim 1, wherein lifting in decompression position takes place in a specified crank-angle range of approximately 90° by appropriate arc length of the bow-shaped member.

6. An automatic decompression system according to claim 1, wherein the switching speed is between 300 and 600 rpm.

7. An automatic decompression system according to claim 1, wherein the control cam is provided with a slot to accommodate the bow-shaped member in engaged position.

8. An automatic decompression system according to claim 1, wherein the inlet valve can be actuated via the same cam as the outlet valve and, in the direction of rotation of the camshaft after the outlet valve, is lifted in addition thereto during the decompression phase.

9. An automatic decompression system according to claim 1, wherein the outlet valve is closed 40° before ignition TDC and the inlet valve is opened 40° past ignition TDC.

10. An automatic decompression system according to claim 1, wherein a valve-dragging lever is provided between said at least one cam and valve.

11. An automatic decompression system according to claim 10, wherein the valve-dragging lever can be lifted by the means of disengagement by 0.2 mm to 0.6 mm.

* * * * *